US006334667B1

(12) United States Patent
Moon et al.

(10) Patent No.: US 6,334,667 B1
(45) Date of Patent: Jan. 1, 2002

(54) INKJETTING DEVICE FOR AN INKJET PRINTER

(75) Inventors: Jae-ho Moon, Seoul; Chang-roul Moon, Euwang; Kyu-ho Shin, Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/182,471

(22) Filed: Oct. 30, 1998

(30) Foreign Application Priority Data

Oct. 31, 1997 (KR) ..... 97-57367

(51) Int. Cl.[7] ..... B41J 2/06
(52) U.S. Cl. ..... 347/54
(58) Field of Search ..... 347/55, 151, 54, 347/120, 141, 154, 103, 123, 111, 159, 127, 128, 131, 125, 158, 53, 327; 399/271, 290, 292, 293, 294, 295, 261; 29/890.1; 310/328–330; 346/74.5; 361/700

(56) References Cited

U.S. PATENT DOCUMENTS 5,206,667 A * 4/1993 Yano .....

* cited by examiner

*Primary Examiner*—Raquel Yvette Gordon
(74) *Attorney, Agent, or Firm*—Staas & Halsey LLP

(57) ABSTRACT

An inkjetting device for an inkjet printer includes a plurality of nozzle plates arranged in a parallel line, and a pair of magnets installed on respective upper and lower portions of the nozzle plates. Each nozzle plate includes a pair of parallel levers, which are connected to a bridge at one end portion and separated from each other at the other end portion, and a nozzle orifice to jet ink is formed on a front face of the bridge. Ink is stored in ink chambers respectively formed between the levers of the pairs of parallel levers. By applying an electric current to each lever in the magnetic field formed by the pair of permanent magnets, a Lorentz force affects each lever to move closer to the other one of the pair of parallel levers. Accordingly, the ink is jetted onto printing paper to execute a printing operation.

21 Claims, 5 Drawing Sheets

INKJETTING DEVICE FOR AN INKJET PRINTER

CROSS-REFERENCE TO RELATED APPLICATIONS

This application claims the benefit of Korean Application No. 57367/1997, filed Oct. 31, 1997, in the Korean Patent Office, the disclosure of which is incorporated herein by reference.

BACKGROUND OF THE INVENTION

1. Field of the Invention

The present invention relates to an inkjetting device for an inkjet printer, and more particularly, relates to an inkjetting device for continuously jetting ink drops by using a plurality of bridge and lever-type nozzle plates, which are operated by a pair of permanent magnets.

2. Description of the Related Art

Generally, the techniques applied for a conventional drop and demand-type inkjet printer head are divided into a piezo-type, a thermal-type, a continuously jetting type and so on. As shown in FIG. 1, the piezo-type has a piezoelectric element 1 to jet ink I and is used in the inkjet printer heads of the Epson company. As shown in FIGS. 2 and 3, the thermal-type has an exothermal body 2 which generates heat to jet the ink I and is used in the inkjet printer heads of the Hewlett-Packard Co., and the Canon Co., respectively. Additionally, as shown in FIG. 4, the continuously jetting type generates a magnetic force and an electrostatic force and is used in other inkjet printer heads.

As shown in FIG. 1, for generating a displacement, a driving signal is applied to the piezoelectric element 1 in the piezo-type inkjet printer head using the piezoelectric element 1. The ink is jetted by transmitting the displacement to the ink I.

As shown in FIGS. 2 and 3, when the driving signal passes through the exothermal body 2 via an electrode (not shown), the exothermal body 2, having a large resistance, generates heat in the thermal type inkjet printer head. The generated heat, which about boils the ink I, generates an air bubble in the ink I. Consequently, the generated air bubble jets the ink I from the inkjet printer head.

As shown in FIG. 4, the continuously jetting type inkjet printer head, which uses the magnetic force and the electrostatic force, has a permanent magnet 3 and a thin film coil 4 to jet the conductive ink I continuously. Accordingly, the generated magnetic force and electrostatic force by the driving signal change a moving direction of an ink drop and print the ink I onto printing paper.

In the piezo-type inkjetting method, a printing speed is low, the printer head cannot have a plurality of nozzles and a production yield is very low because the printer head is very expensive. Moreover, in the thermal-type inkjetting method, a life span of the printer head is short, resolution is lowered, compatibility of the ink is poor and the structure of the printer head is complex. In the continuously jetting type inkjetting method, the printer head consumes a large amount of ink and efficiency is lowered in spite of the fast printing speed.

SUMMARY OF THE INVENTION

Therefore, it is an object of the present invention to provide an inkjetting device for an inkjet printer having a simple structure.

It is another object of the present invention to provide an inkjetting device for an inkjet printer for reducing an amount of ink which is expended by precisely executing the inkjetting operation.

Additional objects and advantages of the invention will be set forth in part in the description which follows and, in part, will be obvious from the description, or may be learned by practice of the invention.

The foregoing and other objects of the present invention are achieved by providing an inkjetting device having at least two nozzle plates arranged in a parallel line, a pair of magnets, such that a first one of the pair of magnets is formed on upper portions of the nozzle plates and a second one of the pair of magnets is formed on lower portions of the nozzle plates. Each nozzle plate includes a pair of parallel levers, which are connected to a bridge at one end portion of the nozzle plate and separated from each other at the other end portion of the nozzle plate, and a nozzle orifice formed at a front surface of the bridge, to jet ink therefrom.

In an embodiment of the present invention, each of the pair of magnets includes a permanent magnet and the polarity of the pair of magnets is determined by a direction of electric current selectively applied to the nozzle plates 102, 104, 106 and 108. Preferably, the polarity of the pair of magnets and the direction of electric current applied to the lever are determined so that force can be generated to allow the parallel pair of levers which form each nozzle plate to become closer to each other.

Moreover, preferably, both end portions of either the upper or the lower portions of the levers of each nozzle plate are fixed to one of the pair of magnets and the remaining portion of the upper or lower of the levers is spaced apart from the one magnet by a predetermined distance. Additionally, the opposite one of the upper or lower portions of the levers is spaced apart from the other magnet of the pair of magnets.

The objects of the present invention will be more clearly understood through a detailed description of the preferred embodiment and the attached drawings.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
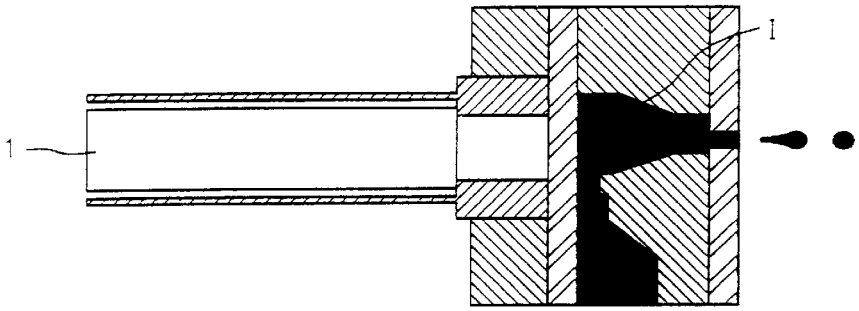
FIG. 1 (Prior Art)
FIG. 1 is a sectional view illustrating a piezo-type inkjetting device of the Epson Co.
Figure 2:
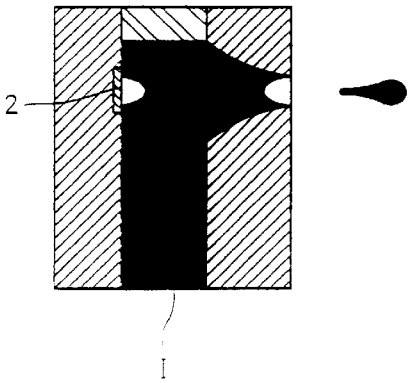
FIG. 2 (Prior Art)
FIGS. 2 and 3 are perspective views illustrating thermal-type inkjetting devices of the Hewlett-Packard Co., and the Canon Co., respectively.
Figure 3:
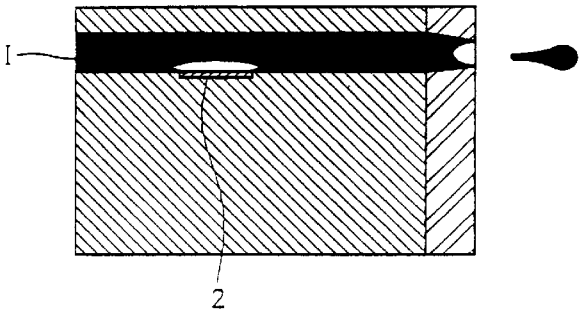
FIG. 3 (Prior Art)
Figure 4:
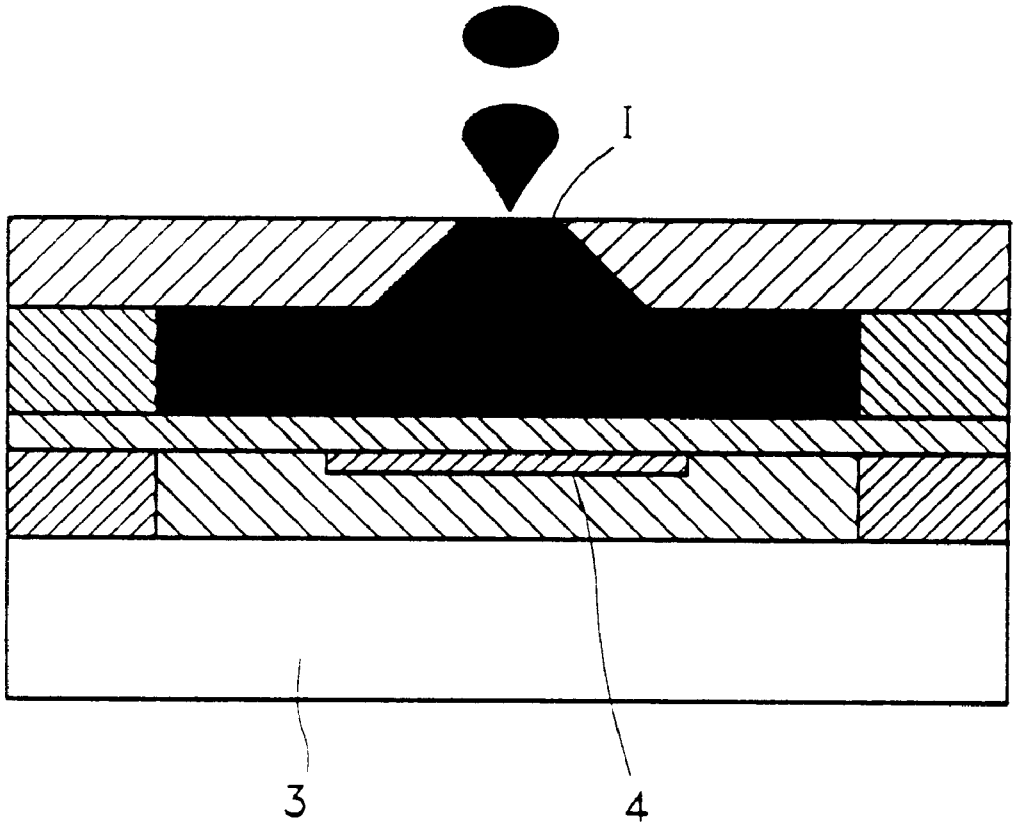
FIG. 4 (Prior Art)
FIG. 4 is a perspective view illustrating a conventional continuously jetting type inkjetting device using a magnetic force and an electrostatic force.

Reference will now made in detail to the present preferred embodiment of the present invention, examples of which are illustrated in the accompanying drawings, wherein like reference numerals refer to the like elements throughout.

The objects, characteristics and advantages of the present invention will be more clearly understood through the preferred embodiment of the present invention by referring to the attached drawings.

In the following description, when the detailed description related to the disclosed function and structure is unnecessarily obvious in explaining the embodiment of the present invention, the detailed description will be omitted.

Figure 5:
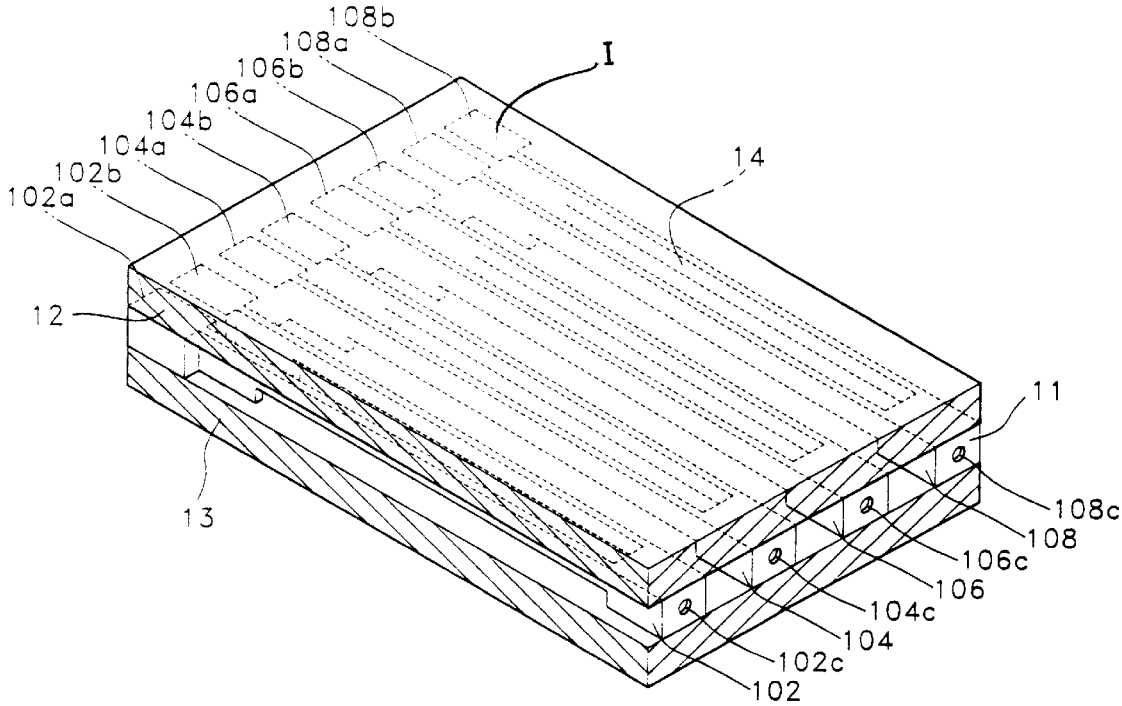
FIG. 5 is a perspective view illustrating an inkjetting device according to an embodiment of the present invention.
Figure 6:
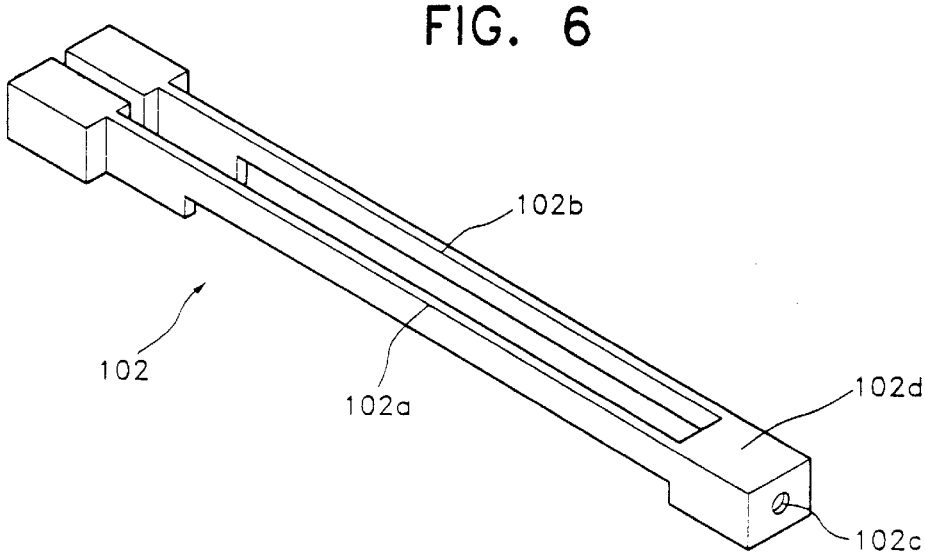
FIG. 6 is a perspective view illustrating a nozzle plate according to the embodiment of the present invention and shown in FIG. 5.

In the embodiment of the present invention, as shown in FIGS. 5 and 6, a plurality of nozzle plates 102, 104, 106 and 108 are arranged in a parallel line. Magnets, for example, permanent magnets 12 and 13, are respectively installed on the upper and lower portions of the nozzle plates 102, 104, 106 and 108.

In more detail, the nozzle plates 102, 104, 106 and 108 have a pair of parallel levers 102*a* and 102*b*, 104*a* and 104*b*, 106*a* and 106*b* and 108*a* and 108*b*, respectively. One end portion of each one of a pair of levers 102*a* and 102*b* is connected by a bridge 102*d* (the end portions of the pairs of levers 104*a* and 104*b*, 106a and 106*b*, and 108*a* and 108*b* are connected by respective bridges as well). The other end portion of each one of the pair of levers 102*a* and 102*b* is separated from the other end portion of the other lever of the same pair of levers 102*a* and 102*b* and forms an ink chamber 14 therebetween for receiving ink I (the other end portions of each one of the pairs of levers 104*a* and 104*b*, 106*a* and 106*b*, and 108*a* and 108*b* are separated from the other portions of the other lever of the same pairs of levers, similar to that shown in FIG. 6, to form ink chambers 14).

Of course, the ink I is not only received in the ink chamber 14 as the spaces between each of the pairs of levers and the ink chambers 14 are respectively connected. But, as subsequently explained, the jetting of the ink by the operation of the levers is restricted to the ink I received in the ink chamber 14, and accordingly, the jetted ink is considered to be separately stored in the area called the ink chamber 14.

The opposite side surface to the permanent magnet 13 of each lever is spaced apart from the permanent magnet 13 by a predetermined distance. Both end portions of the nozzle plates 102, 104, 106 and 108 have lower portions which are fixed to the permanent magnet 13 and spaced apart from the permanent magnet 12 by a predetermined distance. The nozzle orifices 102*c*, 104*c*, 106*c* and 108*c* are respectively formed on the front surfaces of the nozzle plates 102, 104, 106 and 108.

The operation of the above-mentioned inkjetting device according to the embodiment of the present invention will be described hereinafter.

A magnetic field of magnetic flux density B, from the permanent magnet 12 to the permanent magnet 13, is formed by respectively installing the N-poled permanent magnet 12 and the S-poled permanent magnet 13 on the upper and lower portions of the nozzle plates 102, 104, 106 and 108.

Figure 7:
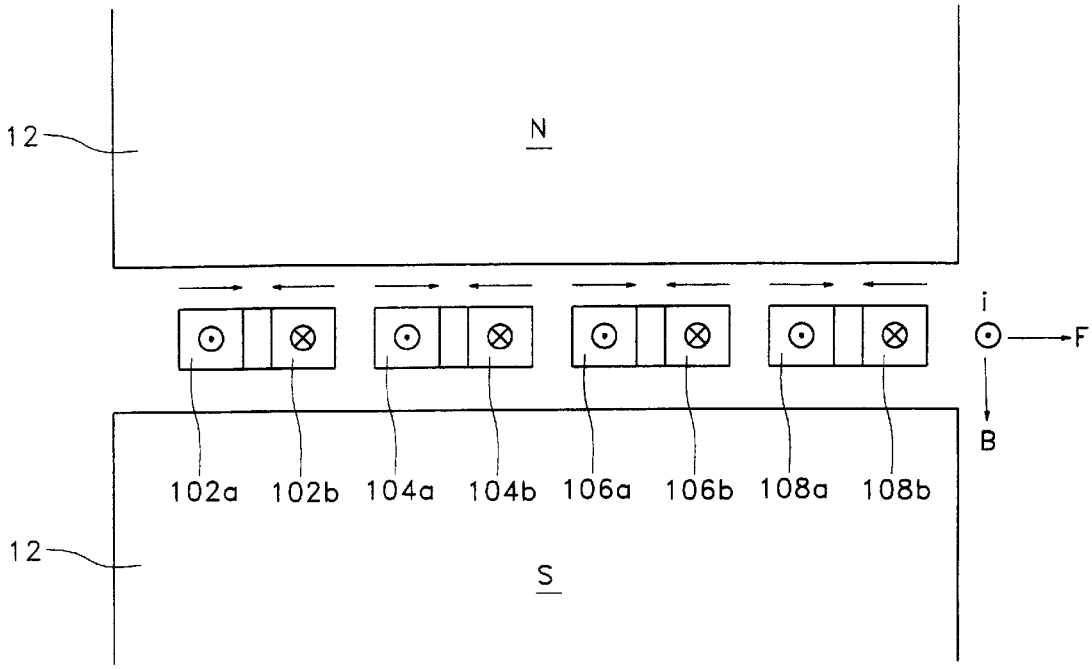
FIG. 7 is rear elevation of the nozzle plate shown in FIG. 6.

Conventionally, a Lorentz force F affects an electric charge, moving in the magnetic field. As shown in FIG. 7, the Lorentz force F is provided in a right direction with respect to the levers 102*a*, 104*a*, 106*a* and 108*a* when electric current i flows in the direction outwardly from the Earth's surface. Moreover, in the same manner, the Lorentz force F is produced in a left direction with respect to the levers 102*b*, 104*b*, 106*b* and 108*b* when the electric current i flows in the direction inwardly to the Earth's surface.

Figure 8:
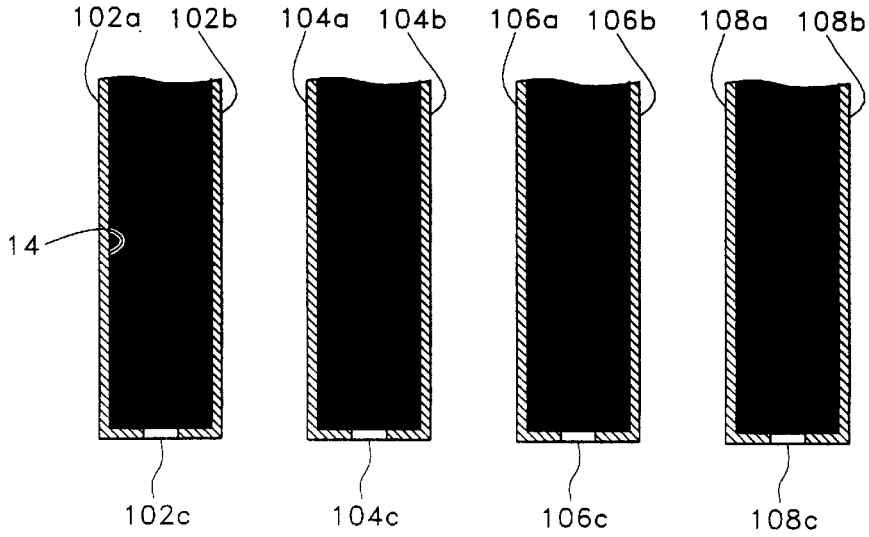
FIG. 8 is a sectional view illustrating a condition before the inkjetting device jets ink according to the embodiment of the present invention.
Figure 9:
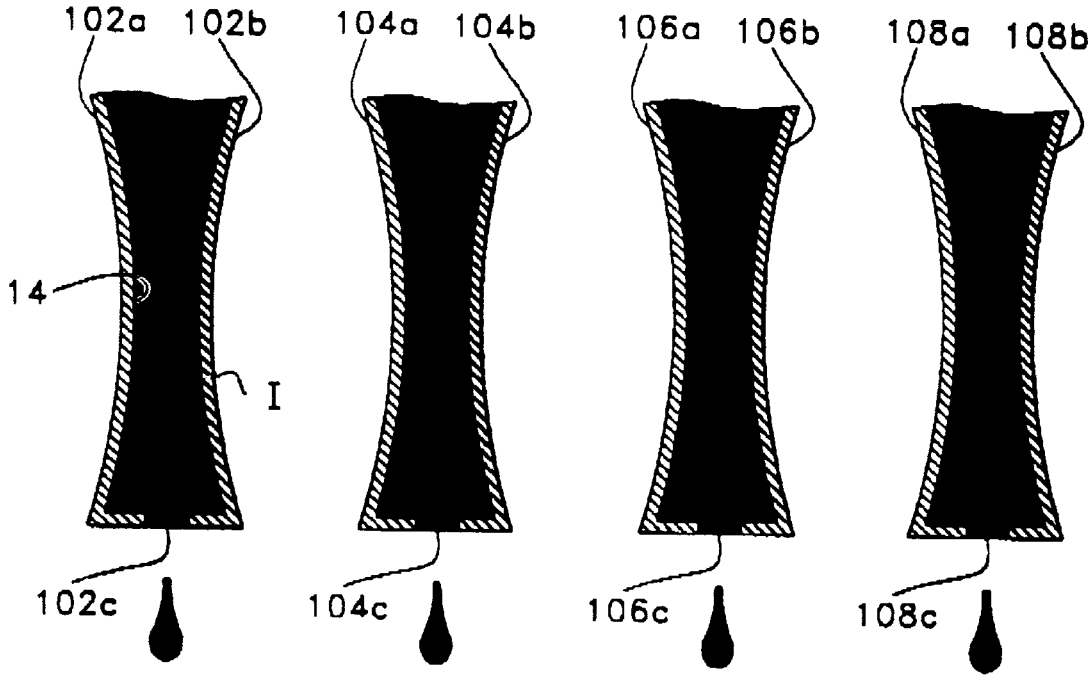
FIG. 9 is a sectional view illustrating a condition of the inkjetting device while jetting the ink, according to the embodiment of the present invention.

Accordingly, as shown in FIGS. 8 and 9, the levers 102*a* , 104*a*, 106*a* and 108*a* and the respectively corresponding levers 102*b*, 104*b*, 106*b* and 108*b* are affected and bent to be respectively closer to each other. Consequently, the volume in the corresponding ink chamber 14 is decreased and the ink I is jetted through the nozzle orifices 102*c*, 104*c*, 106*c* and 108*c*.

That is, by selectively applying the electric current to the nozzle plates 102, 104, 106 and 108, which are arranged between the permanent magnets 12 and 13, in a predetermined direction, the force affects both the right and left levers of the nozzle plates 102, 104, 106 and 108 to be respectively closer to each other. Accordingly, the ink I is jetted, and printing on printing paper is executed.

As mentioned above, the inkjetting device according to the embodiment of the present invention jets ink by applying electric current to a nozzle plate have rectangular bridge-shaped levers. Accordingly, the inkjetting device has a simpler structure than that of the prior art and can reduce the amount of consumption of the ink I by exactly and smoothly executing the inkjetting operation.

As the terms mentioned in the specification are determined based upon the function of the present invention, and they can be changed according to an artisan's intention or usual practice, the terms should be determined considering the overall contents of the specification of the present invention.

While there have been illustrated and described what is considered to be the preferred embodiment of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An inkjetting device of an inkjet printer, comprising:

at least two nozzle plates arranged in a parallel line; and a pair of magnets, wherein a first one of said pair of magnets is formed on first portions of said nozzle plates, and a second one of said pair of magnets is formed on second portions of said nozzle plates opposite the respective first portions;

wherein each of said nozzle plates includes a pair of parallel levers, which are connected to each other by a bridge at one end portion of the nozzle plate and separated from each other at the other end portion of the nozzle plate, and a nozzle orifice formed in a surface of the one end portion of said bridge, to jet ink based upon movement of the pair of parallel levers relative to each other.

2. The inkjetting device according to claim 1, wherein each one of said pair of magnets includes a permanent magnet.

3. The inkjetting device according to claim 1, wherein an electric current is selectively applied to the nozzle plates and a polarity of said pair of magnets is determined by a direction of the electric current selectively applied to the nozzle plates.

4. The inkjetting device according to claim 3, wherein the polarity of said pair of magnets and the direction of the electric current selectively applied to the nozzle plates to generate a force, which cause the parallel levers of the same nozzle plates to move closer to each other.

5. The inkjetting device according to claim 1, wherein both the one end portion and the other end portion of the first or second portion of each nozzle plate are fixed to one of said pair of magnets and a remaining region between the one end portion and the other end portion of the first or second portion is spaced apart from said one of said pair of magnets by a predetermined distance.

6. The inkjetting device according to claim 5, wherein an opposite surface of one surface of said lever is apart from the other one of said pair of said magnets.

7. The inkjetting device according to claim 1, wherein ink chambers to hold the ink are respectively formed between the parallel levers of the same nozzle plates, and said nozzle orifices respectively extend from the one end portion of said bridge to said ink chamber of each of said nozzle plates.

8. The inkjetting device as claimed in claim 1, wherein a dimension of an intermediate region of each of the parallel levers in between the one end portion and the other end portion in a direction from one magnet of said pair of magnets to the other magnet of said pair of magnets is less than a dimension of the one end portion and the other end portion in the direction, so that the intermediate region of each of the parallel levers is spaced apart from the one magnet, and the one magnet is fixed to a bottom surface of the one end portion and the other end portion.

9. The inkjetting device according to claim 1, wherein each nozzle plate has the pair of parallel levers and said bridge integrally formed as one piece.

10. An inkjetting device of an inkjet printer, to jet ink, comprising:

a plurality of nozzle plates arranged in a parallel line, each having a first surface and a second surface opposite the first surface;

a first magnet having a planar surface formed on the first surface of each nozzle plate;

a second magnet having a planar surface formed on the second surface of each nozzle plate;

wherein each nozzle plate includes a pair of flexible levers, forming an ink chamber to hold the ink therebetween, and having first ends separated from each other and second ends connected to each other at a bridge, and a nozzle orifice formed in said bridge and extending through said to said ink chamber, and said pair of flexible levers move toward each other to force the ink from said ink chamber and through said nozzle orifice in response to an electric current being selectively applied to the nozzle plate.

11. The inkjetting device according to claim 10, wherein each flexible lever has a recess formed in said second surface in an intermediate region between said first and second ends, said intermediate region being spaced apart from said second magnet.

12. The inkjetting device according to claim 11, wherein each recess has a rectangular cross-section.

13. The inkjetting device according to claim 10, wherein a polarity of said first and second magnets and a direction of the electric current selectively applied to each nozzle plate generate a force to move one lever of each pair of flexible levers toward the other one lever of said pair of flexible levers.

14. The inkjetting device according to claim 10, wherein the first and second ends of each of said flexible levers are fixed to said second magnet.

15. The inkjetting device according to claim 11, wherein each of said recesses is aligned with the other recesses and enable the ink to flow on the planar of said second magnet and between said ink chambers of said nozzle plates.

16. An inkjetting device of an inkjet printer, comprising:

a plurality of nozzle plates each selectively receiving an electric signal; and first and second magnets formed at opposite sides of said plurality of nozzle plates and producing a magnetic field;

wherein each of said plurality of nozzle plates includes a pair of levers which form an ink chamber therebetween to hold the ink, and move relative to each other in response to a force generated due to the magnetic field and the electric signal selectively applied to said nozzle plate, and a nozzle orifice extending to said ink chamber, wherein the ink is forced from said ink chamber and through said nozzle orifice in response to the motion of said pair of levers relative to each other.

17. The inkjetting device according to claim 16, wherein each pair of levers comprises:

a first lever having a first end and a second end;

a second lever having a first end connected at a bridge to said first end of said first lever and a second end spaced apart from said second end of said first lever, said nozzle orifice being formed in a surface of said bridge.

18. The inkjetting device according to claim 17, wherein said first and second levers of each pair of said levers are parallel to each other in response to no electric signal being applied to the corresponding nozzle plate.

19. The inkjetting device according to claim 17, wherein the first and second ends of each of said levers are fixed to said second magnet.

20. The inkjetting according to claim 17, wherein each of said levers has an intermediate region in between said first and second ends, and said intermediate region is spaced apart from said second magnet.

21. A device, comprising:

a pair of levers, connected to each other by a bridge; and a nozzle orifice formed in said bridge, ink being jetted through said orifice in response to movement of said pair of levers relative to each other.

* * * * *